US008174192B2

(12) United States Patent
Ueda et al.

(10) Patent No.: US 8,174,192 B2
(45) Date of Patent: May 8, 2012

(54) PLASMA DISPLAY PANEL

(75) Inventors: Kentaro Ueda, Osaka (JP); Nobutaka Hokazono, Osaka (JP); Masanori Suzuki, Osaka (JP); Toshifumi Nagino, Osaka (JP); Ryuichi Murai, Osaka (JP)

(73) Assignee: Panasonic Corporation, Osaka (JP)

( * ) Notice: Subject to any disclaimer, the term of this patent is extended or adjusted under 35 U.S.C. 154(b) by 1035 days.

(21) Appl. No.: 11/795,840

(22) PCT Filed: Dec. 27, 2006

(86) PCT No.: PCT/JP2006/026000

§ 371 (c)(1),
(2), (4) Date: Jul. 23, 2007

(87) PCT Pub. No.: WO2007/077852

PCT Pub. Date: Jul. 12, 2007

(65) Prior Publication Data

US 2008/0158106 A1 Jul. 3, 2008

(30) Foreign Application Priority Data

Dec. 27, 2005 (JP) ..... 2005-374460

(51) Int. Cl.
*H01J 17/49* (2012.01)

(52) U.S. Cl. ..... 313/582; 313/584; 313/587

(58) Field of Classification Search ..... 313/582–587
See application file for complete search history.

(56) References Cited

U.S. PATENT DOCUMENTS

2002/0180354 A1* 12/2002 Sano et al. ..... 313/582
2005/0218807 A1* 10/2005 Min ..... 313/582

FOREIGN PATENT DOCUMENTS

JP 2000-268722 9/2000
JP 2001-6557 1/2001
JP 2003-131580 5/2003
JP 2007178880 A * 7/2007

* cited by examiner

*Primary Examiner* — Mariceli Santiago
(74) *Attorney, Agent, or Firm* — Wenderoth, Lind & Ponack L.L.P.

(57) ABSTRACT

A plasma display panel includes a front panel having a front substrate having a plurality of arrays of display electrodes each including a scanning electrode and a sustain electrode opposed to each other with a discharge gap being defined therebetween and a rear panel having a rear substrate opposed to a front substrate and having partition walls for partitioning a discharge space between the rear panel and the front panel, data electrodes formed between partition walls in such a fashion that the data electrodes intersect with the display electrodes, and phosphor layers formed between partition walls, wherein the rear panel forms partition walls so as to divide the discharge space in a plurality of regions along a direction parallel to the data electrodes, and blue phosphor layers are formed on boundary parts of the plural regions.

12 Claims, 7 Drawing Sheets

PLASMA DISPLAY PANEL

THIS APPLICATION IS A U.S. NATIONAL PHASE APPLICATION OF PCT INTERNATIONAL APPLICATION PCT/JP2006/32600.

BACKGROUND OF THE INVENTION

1. Field of the Invention

This invention relates to a plasma display panel to be used as a display device of a plasma display apparatus.

2. Description of Related Art

Driving types of panels that have heretofore been used in plasma display apparatuses are broadly classified into two types, namely, an AC type and a DC type, and there are two types of discharge methods, namely, a surface discharge and a counter discharge. From the stand points of high resolution, large display screen, and production convenience, mainstream plasma display panels are of the surface discharge type having a three-electrode structure.

The plasma display panel of the surface discharge type has a pair of substrates opposed to each other so as to form a discharge space between the substrates, at least the front substrate of which is transparent, and partitions that are disposed on the substrates for partitioning the discharge space into plural discharge spaces. Further, electrodes are disposed on the substrates so as to generate a discharge in each of the discharge spaces defined by the partitions, and phosphors emitting red, greed, and blue lights by the discharges are provided to form plural discharge cells. The phosphors are excited by vacuum ultraviolet light generated by the discharge and having a short wavelength, so that visible red, green, and blue lights are emitted from the red, green, and blue discharge cells.

Among flat panel displays, the plasma display panel has attracted attention particularly in recent years for the reasons of capability of high speed display as compared to liquid crystal panels, wide visual angle, easiness for increasing size, high display quality due to self-luminosity, and the like and has been used for various applications as a display apparatus in a place where a large number of people assemble and as a display apparatus for enjoying images on the large display screen at home.

In such plasma display apparatus, a module is formed in such a manner that a panel made mainly from glass is retained by a front surface of a chassis member made from a metal such as aluminum and a circuit board forming a driving circuit for causing the panel to emit light is disposed on a rear surface of the chassis (see Patent Publication 1).

Plasma display apparatuses having the size of 65 inches or more have recently been produced and sold since it is possible to easily realize the large screen in such plasma display apparatuses. Also, due to an increase in demand for display with higher resolution, the mainstream products are shifting from apparatuses achieving a resolution of 768×1366 to apparatuses achieving a higher resolution of 1080×1920.

Along with the increases in size of display screen and resolution of plasma display panel, a necessity for making a review of component parts forming the product is being raised.

[Patent Publication 1] Japanese Patent Unexamined Publication No. 2003-131580.

BRIEF SUMMARY OF THE INVENTION

This invention has been accomplished in view of the circumstances described above, and an object thereof is to provide a plasma display panel suitable for achieving a large display screen and a high resolution.

This invention is characterized by comprising a front panel having a front substrate having a plurality of arrays of display electrodes each including a first electrode and a second electrode opposed to each other with a discharge gap being defined therebetween and a rear panel having a rear substrate opposed to the front substrate and having partition walls for partitioning a discharge space between the rear panel and the front panel, data electrodes each formed between the partition walls in such a fashion that the data electrodes intersect with the display electrodes, and red, green, and blue phosphor layers each formed between the partition walls, wherein the rear panel forms the partition walls so as to divide the discharge space in a plurality of regions along a direction parallel to the data electrodes, and the blue phosphor layers are formed on boundary parts of the plural regions.

According to this invention, it is possible to realize the large display screen of the panel with display quality being maintained to a predetermined quality.

DESCRIPTION OF REFERENCE NUMERALS AND SIGNS

1: front panel

1*a*, 2*a*: alignment mark

Figure 1:
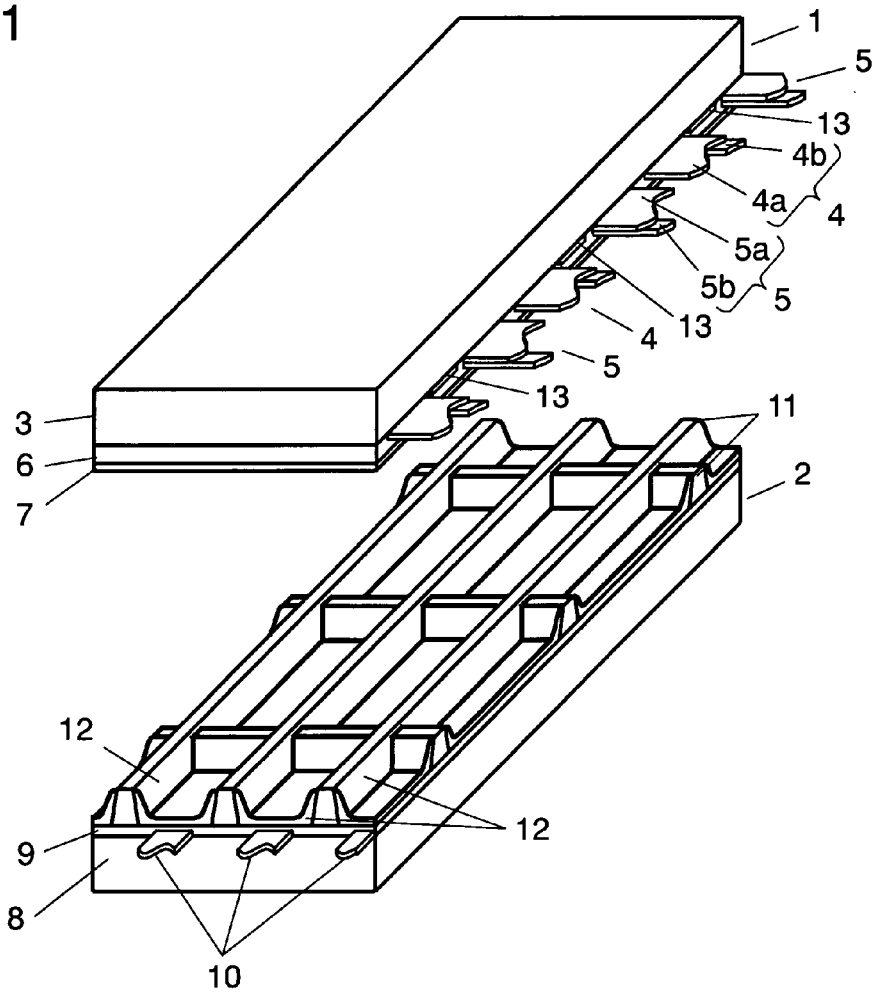
FIG. 1 is a perspective view showing a major part of a panel to be used for a plasma display panel according to one embodiment of this invention.

2: rear panel
3: front substrate
4: scanning electrode
5: sustain electrode
4*a*, 5*a*: transparent electrode
4*b*, 5*b*: bus electrode
6: dielectric layer
7: protection layer
8: rear substrate
9: insulating layer
10: data electrode
11: partition wall
12: phosphor layer
12R: red phosphor layer
12G: green phosphor layer
12B: blue phosphor layer
13: light shielding layer
14: boundary portion

DETAILED DESCRIPTION OF THE INVENTION (Embodiment)

Hereinafter, a plasma display panel according to one embodiment of this invention will be described by using FIGS. 1 to 8. Note that embodiment of this invention is not limited to this embodiment.

To start with, a structure of the plasma display panel will be described by using FIG. 1.

FIG. 1 is a perspective view showing a major part of a panel to be used for the plasma display panel according to one embodiment of this invention. As shown in FIG. 1, the plasma display panel is formed of front panel 1 and rear panel 2. Front panel 1 and rear panel 2 are opposed to each other with a discharge space being formed therebetween, and a peripheral part thereof is sealed with a sealing material (not shown) made from a glass frit. The discharge space is charged with a discharge gas such as a mixture gas of neon and xenon.

In front panel 1, a plurality of arrays of display electrodes each including a pair of scanning electrode 4 serving as a first electrode and sustain electrode 5 serving as a second electrode which are opposed to each other with a discharge gap being defined therebetween and aligned parallel to each other are formed on front substrate 3 made from glass. Dielectric layer 6 made from a glass material is formed so as to cover scanning electrodes 4 and sustain electrodes 5, and protection layer 7 made from MgO is formed on dielectric layer 6. Each of scanning electrode 4 and sustain electrode 5 is formed of transparent electrode 4*a*, 5*a* made from ITO (Indium Tin Oxide) and bus electrode 4*b*, 5*b* which is formed on transparent electrode 4*a*, 5*a* and made from an electroconductive material such as Ag.

In rear panel 2, rear substrate 8 made from glass and opposed to front substrate 3 is provided with data electrodes 10 made from an electroconductive material such as Ag and covered with insulating layer 9 made from a glass material. Partition walls 11 are formed in a grid pattern on insulating layer 9 for partitioning the discharge space between rear panel 2 and front panel 1, and each of red, green, and blue phosphor layers 12 is disposed between partition walls 11. Data electrodes 10 of rear panel 2 are aligned in such a fashion that each of data electrodes 10 intersects with scanning electrodes 4 and sustain electrodes 5 of front panel 1 between partition walls 11, and the discharge cells are formed at positions where scanning electrodes 4 and sustain electrodes 5 intersect with data electrodes 10.

Black shielding layer 13 for improving a contrast is provided between scanning electrode 4 and sustain electrode 5 of front panel 1.

The structure of the panel is not limited to the above-described one, and the panel may be provided with partition walls in the form of stripes. Also, though scanning electrode 4 and sustain electrode 5 are aligned alternately as "scanning electrode 4-sustain electrode 5-scanning electrode 4-sustain electrode 5 . . . " in the alignment of scanning electrodes 4 and sustain electrodes 5 shown in FIG. 1, scanning electrodes 4 and sustain electrodes 5 may be aligned as "scanning electrode 4-sustain electrode 5-sustain electrode 5-scanning electrode 4 . . . ".

Figure 2:
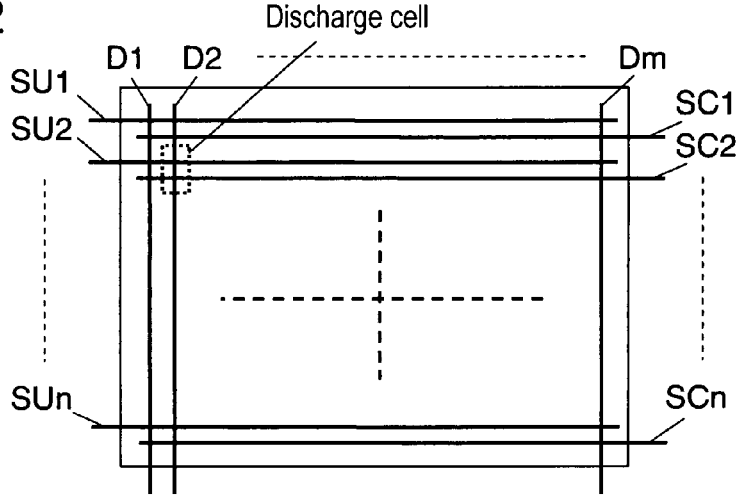
FIG. 2 is a diagram showing an electrode alignment of the panel to be used for the plasma display panel according to one embodiment of this invention.

FIG. 2 is a diagram showing an electrode alignment of the panel to be used for the plasma display panel according to one embodiment of this invention. Referring to FIG. 2, n scanning electrodes SC1 to SCn (scanning electrodes 4 in FIG. 1) and n sustain electrodes SU1 to SUn (sustain electrodes 5 in FIG. 1) are aligned in a row direction, and m data electrodes D1 to Dm (data electrodes 10 in FIG. 1) are aligned in a column direction. Each of the discharge cells is formed on a part where a pair of scanning electrode SCi and sustain electrode SUi (i=1 to n) intersects with data electrode Dj (j=1 to m). The number of discharge cells existing in the discharge space is m×n.

Figure 3:
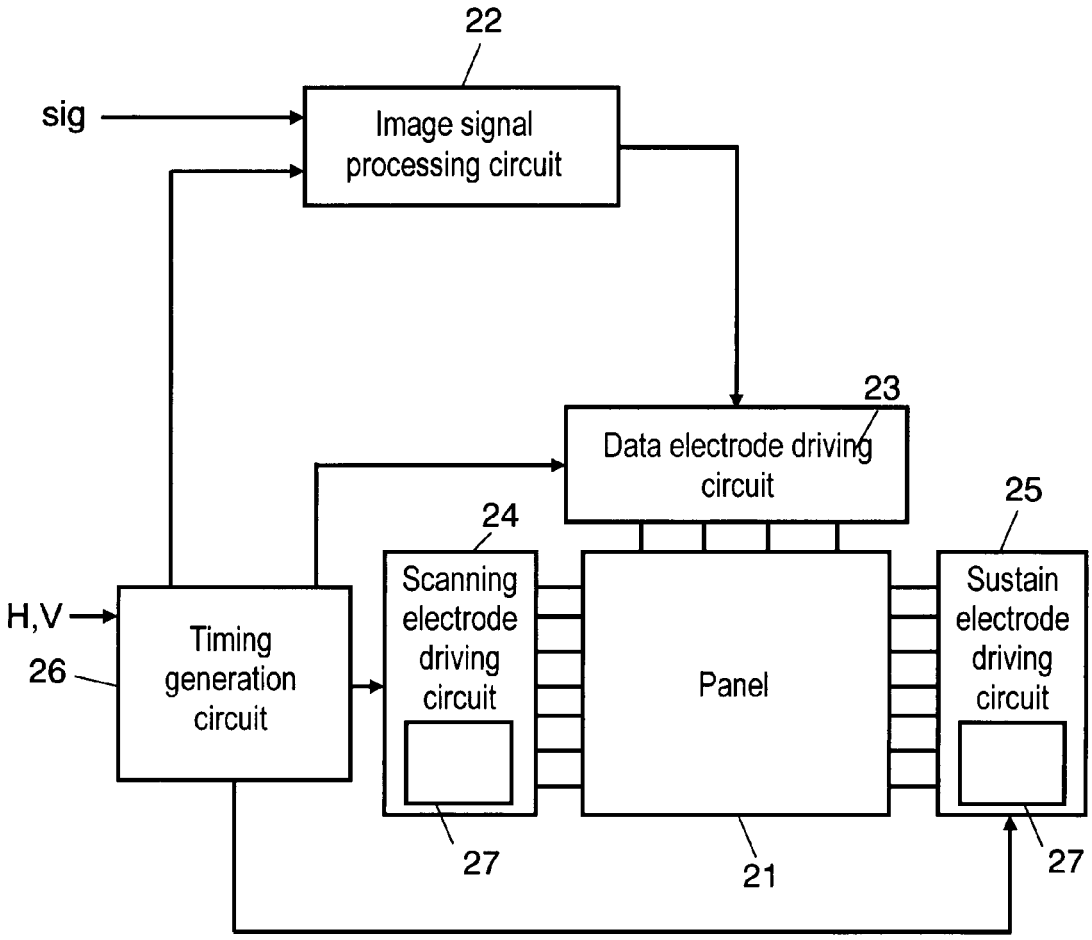
FIG. 3 is a diagram showing circuit blocks of a plasma display apparatus to be used for the plasma display panel according to one embodiment of this invention.

FIG. 3 is a diagram showing circuit blocks of a plasma display apparatus to be used for the plasma display panel according to one embodiment of this invention. Referring to FIG. 3, the plasma display apparatus is provided with panel 21, image signal processing circuit 22, data electrode driving circuit 23, scanning electrode driving circuit 24, sustain electrode driving circuit 25, timing generation circuit 26, and a power circuit (not shown).

Image signal processing circuit 22 converts an image signal sig into image data for each of subfields. Data electrode driving circuit 23 converts the image data for each of the subfields into a signal corresponding to each of data electrodes D1 to Dm to drive data electrodes D1 to Dm. Timing generation circuit 26 generates various timing signals based on horizontal synchronization signal H and vertical synchronization signal V to supply the generated signals to the driving circuit blocks. Scanning electrode driving circuit 24 supplies a driving voltage waveform to scanning electrodes SC1 to SCn based on the timing signal, and sustain electrode driving circuit 25 supplies a driving voltage waveform to sustain electrodes SU1 to SUn based on the timing signal. Each of scanning electrode driving circuit 24 and sustain electrode driving circuit 25 is provided with sustain pulse generation unit 27.

Hereinafter, the driving voltage waveforms for driving the panel and operation of the panel will be described by using FIG. 4.

Figure 4:
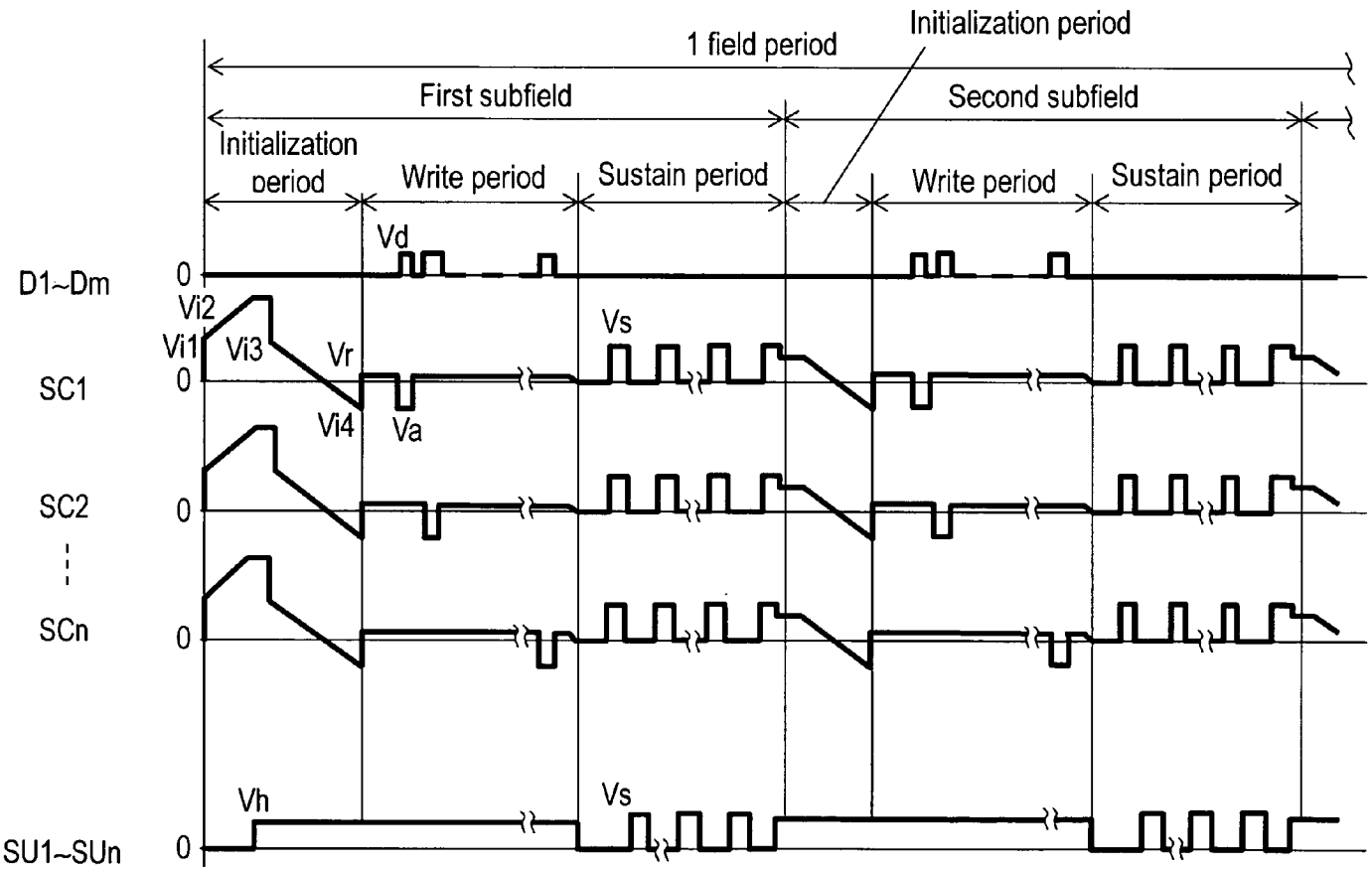
FIG. 4 is a waveform chart showing driving voltage waveforms to be applied to the electrodes of the panel to be used for the plasma display panel according to one embodiment of this invention.

FIG. 4 is a waveform chart showing the driving voltage waveforms to be applied to the electrodes of the panel to be used for the plasma display panel according to one embodiment of this invention. In the plasma display apparatus according to this embodiment, one field is divided into plural subfields, and each of the subfields has an initialization period, a write period, and a sustain period.

Referring to FIG. 4, in the initialization period of the first subfield, data electrodes D1 to Dm and sustain electrodes SU1 to SUn are retained at 0 (V), and a ramp voltage gradually rising from voltage Vi1 (V) which is equal to or lower than a discharge start voltage to voltage Vi2 (V) which exceeds the discharge start voltage is applied to scanning electrodes SC1 to SCn. With the application of ramp voltage, a first weak initialization discharge occurs in the entire discharge cells, so that a negative wall voltage is stored on scanning electrodes SC1 to SCn while a positive wall voltage is stored on sustain electrodes SU1 to SUn and data electrodes D1 to Dm. The wall voltage on the electrodes is a voltage generated by wall charges accumulated on the dielectric layer, the phosphor layers, and the like covering the electrodes.

After that, sustain electrodes SU1 to SUn are retained to positive voltage Vh (V), and a ramp voltage gradually damping from voltage Vi3 (V) to voltage Vi4 (V) is applied to scanning electrodes SC1 to SCn. With the application of ramp electrode, a second weak initialization discharge occurs in the entire discharge cells, so that the wall voltage between scanning electrodes SC1 to SCn and sustain electrodes SU1 to SUn is weakened, and that the wall voltage on data electrodes D1 to Dm is adjusted to a value suitable for a write operation.

In the following write period, scanning electrodes SC1 to SCn are temporarily retained at Vr (V). Next, negative scanning pulse voltage Va (V) is applied to scanning electrode SC1 on the first row, and positive write pulse voltage Vd (V) is applied to data electrode Dk (k=1 to m) among data electrodes D1 to Dm of the discharge cell to be displayed on the first row. At this time point, a voltage at the intersection of data electrode Dk and scanning electrode SC becomes a voltage which is a sum of externally applied voltage (Vd−Va) (V), the wall voltage on data electrode Dk, and the wall voltage on scanning electrode SC1 and exceeds the discharge start voltage. After that, a write discharge occurs between data electrode Dk and scanning electrode SC1 and between sustain electrode SU1 and scanning electrode SC1, so that a positive wall voltage is stored on scanning electrode SC1 of the discharge cell, a negative wall voltage is stored on sustain electrode SU1, and a negative voltage is stored on data electrode Dk.

As described above, the write operation for accumulating wall voltages on the electrodes is performed by causing the write discharges in the discharge cells to be displayed on the first row. In turn, since a voltage of each of intersections of data electrodes D1 to Dm to which write pulse voltage Vd (V) was not applied and scanning electrode SC1 does not exceed the discharge start voltage, the write discharge does not occur at the intersections. The above-described write operation is sequentially performed up to the discharge cells on the n-th row to terminate the write period.

In the following sustain period, positive pulse voltage Vs (V) is applied as a first voltage to scanning electrodes SC1 to SCn, and a ground voltage, i.e. 0 (V), is applied as a second voltage to sustain electrodes SU1 to SUn. At this time point, in the discharge cell in which the write discharge has occurred, the voltage between scanning electrode SCi and sustain electrode SUi becomes a sum of sustain pulse voltage Vs (V), the wall voltage of scanning electrode SCi, and the wall voltage of the sustain electrode SUi to exceed the discharge start voltage. After that, a sustain discharge occurs between scanning electrode SCi and sustain electrode SUi, and ultraviolet light generated by the sustain discharge causes the phosphor layer to emit light. After that, a negative wall voltage is accumulated on scanning electrode SCi, while a positive wall voltage is accumulated on sustain electrode SUi. At this time point, a positive wall voltage is also accumulated on data electrode Dk.

In the discharge cell in which the write discharge did not occur during the write period, the sustain discharge does not occur, and the wall voltage at the time of the termination of the initialization period is maintained. Next, a voltage 0 (V) which is the second voltage is applied to scanning electrodes SC1 to SCn, and sustain pulse voltage Vs (V) which is the first voltage is applied to sustain electrodes SU1 to SUn. In the discharge cell where the sustain discharge has occurred, since the voltage between sustain electrode SUi and scanning electrode SCi exceeds the discharge start voltage, a sustain discharge occurs again between sustain electrode SUi and scanning electrode SCi, so that a negative wall voltage is accumulated on sustain electrode SUi, and a positive wall voltage is accumulated on scanning electrode SCi.

By applying a sustain pulse for a number of times corresponding to a weight of brightness alternately to scanning electrodes SC1 to SCn and sustain electrodes SU1 to SUn in the same manner as described above, the sustain discharge is continuously performed in the discharge cell in which the write discharge has occurred during the write period. Thus, the sustain operation in the sustain period is completed.

Since operations of the initialization period, the write period, and sustain period in the following subfields are substantially the same as those of the first subfield, description for the operations are omitted.

Figure 5:
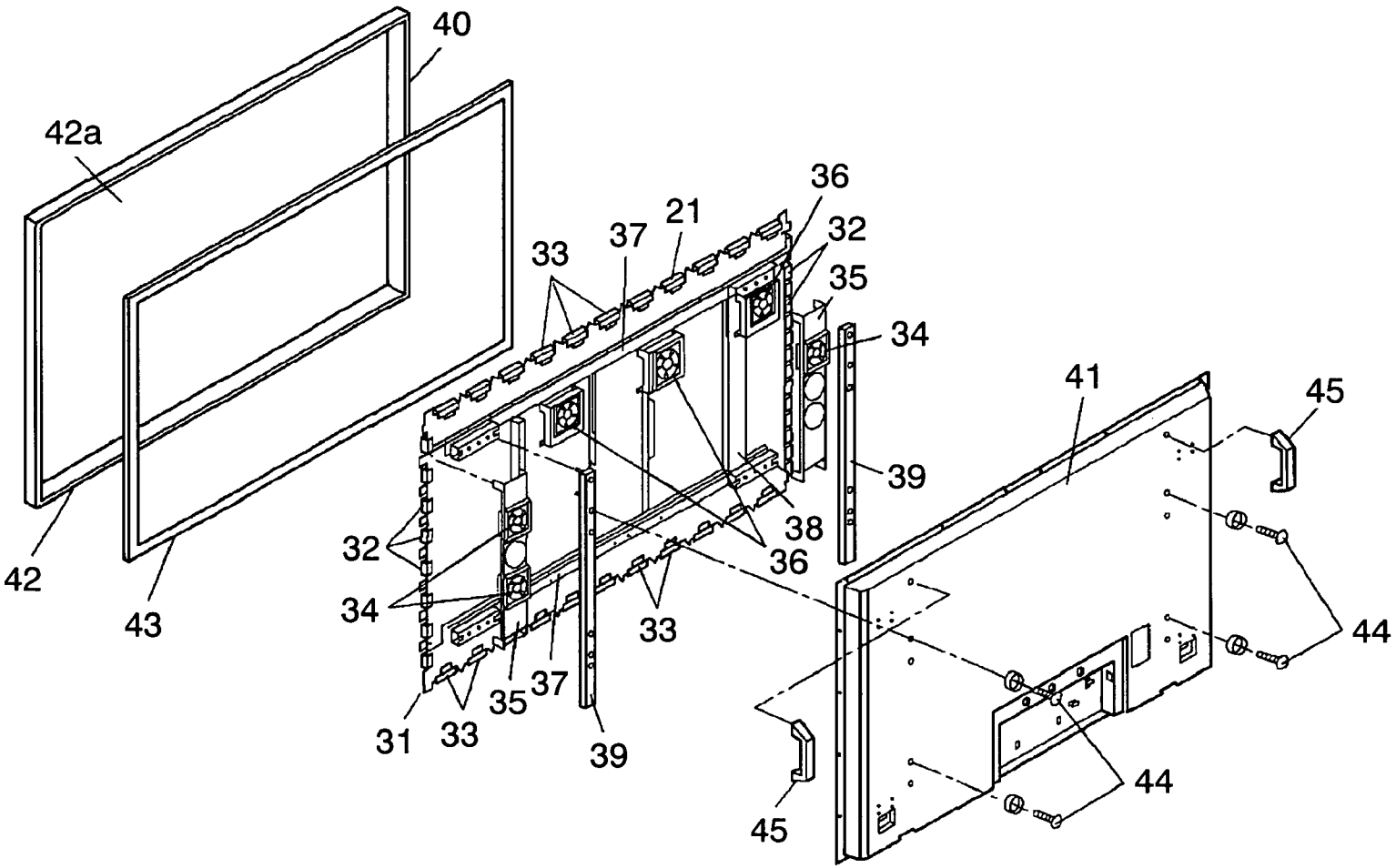
FIG. 5 is an exploded perspective view showing an overall structure of a plasma display apparatus provided with the plasma display panel according to one embodiment of this invention.

FIG. 5 is an exploded perspective view showing an overall structure of a plasma display apparatus provided with the plasma display panel according to one embodiment of this invention. Referring to FIG. 5, chassis member 31 is formed from a holding plate made from a metal such as aluminum and serves also as a heating plate. Panel 21 is retained at a front surface of chassis member 31 as being adhered to the front surface by an adhesive material and the like with a heat release sheet (not shown) being disposed therebetween. A plurality of driving circuit blocks (not shown) for driving panel 21 for display are disposed on a rear surface of chassis member 31 to form a module.

The heat release sheet is used for retaining panel 21 at the front surface of chassis member 31 by the adhesion and efficiently transmitting heat generated by panel 21 to chassis member 31 to release the heat and has a thickness of about 1 to 2 mm. As the heat release sheet, an insulating heat release sheet containing a synthetic resin material such as acryl, urethane, a silicon resin, and a rubber and a filler for improving the heat conductivity, a graphite sheet, a metal sheet, or the like may be used. Also, the heat release sheet itself may be adhesive so as to attach panel 21 to chassis member 31 only with the sheet, or panel 21 may be attached to chassis member 31 with a double sided adhesive tape and using a non-adhesive heat release sheet.

Flexible wiring boards 32 are provided at each of opposite rims of panel 21 to be used as display electrode wiring members connected to electrode drawing parts of scanning electrodes 4 and sustain electrodes 5. Flexible wiring boards 32 are lead to the rear surface of chassis member 31 via an outer periphery of chassis member 31 and connected to the driving circuit block of scanning electrode driving circuit 24 and the driving circuit block of sustain electrode driving circuit 25 via a connector.

Flexible wiring boards 33 are provided at each of lower and upper rims of panel 21 to be used as data electrode wiring members connected to electrode drawing parts of data electrodes 10. Flexible wiring boards 33 are electrically connected to plural data drivers of data electrode driving circuit 23 and lead to the rear surface of chassis member 31 via the outer periphery of chassis member 31 to be electrically connected to the driving circuit block of data electrode driving circuit 23 disposed at a lower part and an upper part of the rear surface of chassis member 31.

In the vicinity of the driving circuit blocks, cooling fan 34 is disposed as being retained by angle 35, and the driving circuit block is cooled by the wind from cooling fan 34. Further, three cooling fans 36 are disposed at an upper portion of chassis member 31. Cooling fans 36 cools the driving circuit block of data electrode driving circuit 23 disposed at the upper portion as well as the inside of the apparatus by causing an air flow in the rear surface of chassis member 31 from a lower part to an upper part of the inside of the apparatus.

Reinforcing angles 37 and 38 are fixed to chassis member 31 in a horizontal direction and a vertical direction. Stand pole 39 for retaining the apparatus upright is fixed to horizontally disposed angle 37 with a screw and the like.

The module having the above-described structure is housed in a housing having front protection cover 40 disposed on the front surface of panel 21 and metal back cover 41 disposed on the rear surface of chassis member 31 to complete the plasma display apparatus.

Front protection cover 40 is provided with front frame 42 having opening 42*a* for exposing an image display region of the front surface of panel 21 and made from a resin and a metal and protection plate 43 attached to opening 42*a* of front frame 42 and made from glass provided with an optical filter and an unnecessary radiation suppression film for suppressing unnecessary radiation of electromagnetic wave. Protection plate 43 is attached to front frame 42 in such a fashion that an edge portion of protection plate 43 is sandwiched by a peripheral portion of opening 42*a* of front frame 42 and a protection plate holding metal (not shown). Back cover 41 is provided with plural air holes (not shown) for releasing heat generated in the module to the outside.

Referring to FIG. 5, back cover 41 is attached to chassis member 31 by screws 44, and holding part 45 is attached to back cover 41 by a screw and the like.

Hereinafter, a characteristic structure of this invention, which realizes the large size plasma display panel, will be described.

As a method for forming the component parts of the plasma display panel, an exposure process wherein a photosensitive material layer on a substrate is exposed via a photomask on which a predetermined pattern is plotted is employed in the case of forming a pattern on the photosensitive material layer formed on the substrate. Also, due to the increase in size of display panel, it is necessary to expose a wide region that is not fitted in an exposure region of an exposure apparatus in the exposure process. Therefore, as a method for realizing the large area exposure, an exposure method for exposing the exposure region by dividing the exposure region into plural small regions is employed.

Figure 6A:
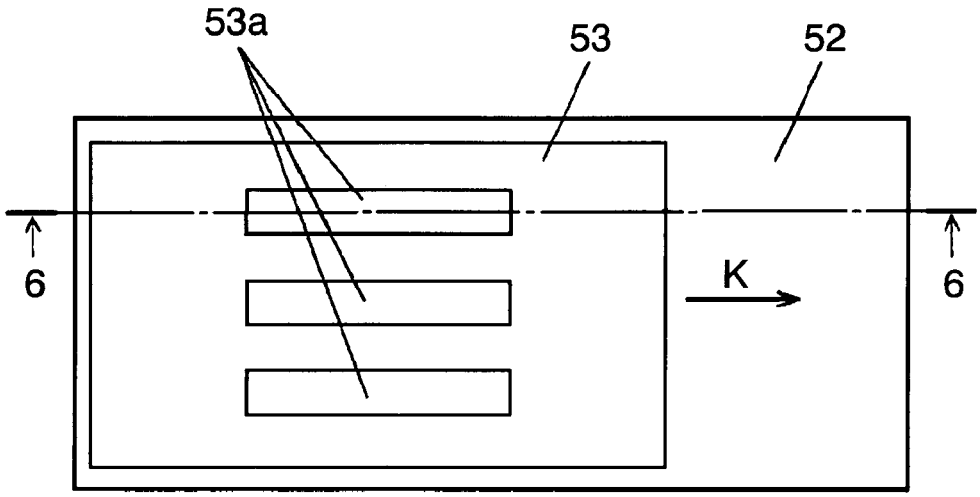
FIG. 6A is a plan view showing a case of subjecting a left area of a substrate to light exposure by using a division exposure method to be employed for the plasma display panel according to one embodiment of this invention.
Figure 6B:
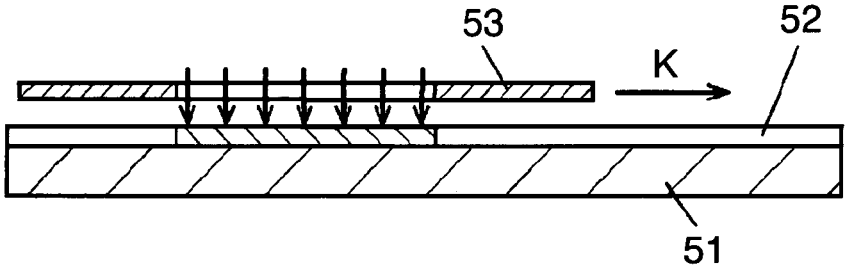
FIG. 6B is a sectional view taken along a 6-6 line of FIG. 6A.
Figure 6C:
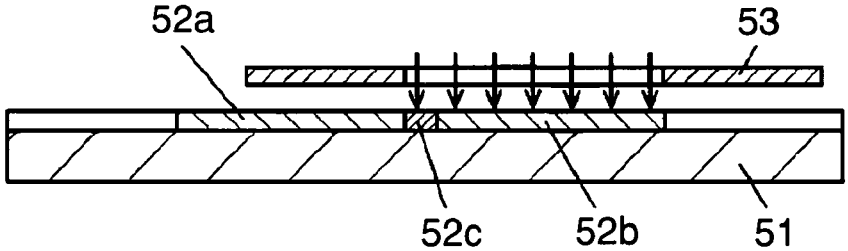
FIG. 6C is a sectional view taken along the 6-6 line when subjecting a right area of the substrate to the light exposure.

FIGS. 6A to 6C are diagrams for illustrating the division exposure method to be employed for the plasma display panel according to one embodiment of this invention. In the diagrams, the exposure method in the case of exposing photosensitive material layer 52 formed by coating on substrate 51 via photomask 53 is shown.

FIG. 6A is a plan view showing a case of subjecting a left area of substrate 51 to light exposure. FIG. 6B is a sectional view taken along a 6-6 line of FIG. 6A. FIG. 6C is a sectional view taken along the 6-6 line when subjecting a right area of substrate 51 to the light exposure. As shown in FIGS. 6A to 6C, photosensitive material layer 52 such as a silver paste for forming the component parts of the plasma display panel is formed on substrate 51. Photomask 53 is disposed on an upper part of the left area of substrate 51 with a predetermined distance being defined from photosensitive material layer 52. Photomask 53 is provided with openings 53*a*.

As shown in FIGS. 6A to 6C, since substrate 51 is larger than photomask 53, photomask 53 is moved in a direction of arrow K to divide a region of substrate 51 into left and right areas, and division exposure is performed twice for a whole region of substrate 51. Openings 53*a* are provided for the purpose of forming electrode patterns of the plasma display panel. Through openings 53*a*, photosensitive material layer 52 is exposed to light from an exposure light source (not shown) provided above photomask 53. Exposure area 52*a* is on the left of connection part 52*c* and exposure area 52*b* is on the right of connection part 52*c*. In this embodiment, a region including unexposed parts of photosensitive material layer 52 is removed by the following development step.

Figure 7A:
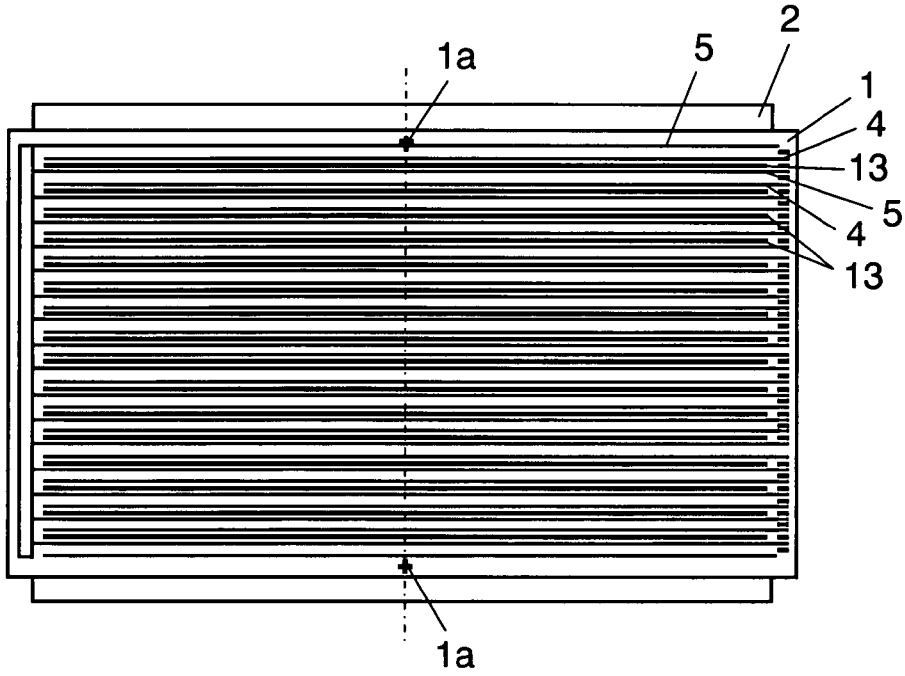
FIG. 7A is a plan view schematically showing a plasma display panel of this invention as viewed from a front panel side, the component parts of which are formed by the division exposure method.
Figure 7B:
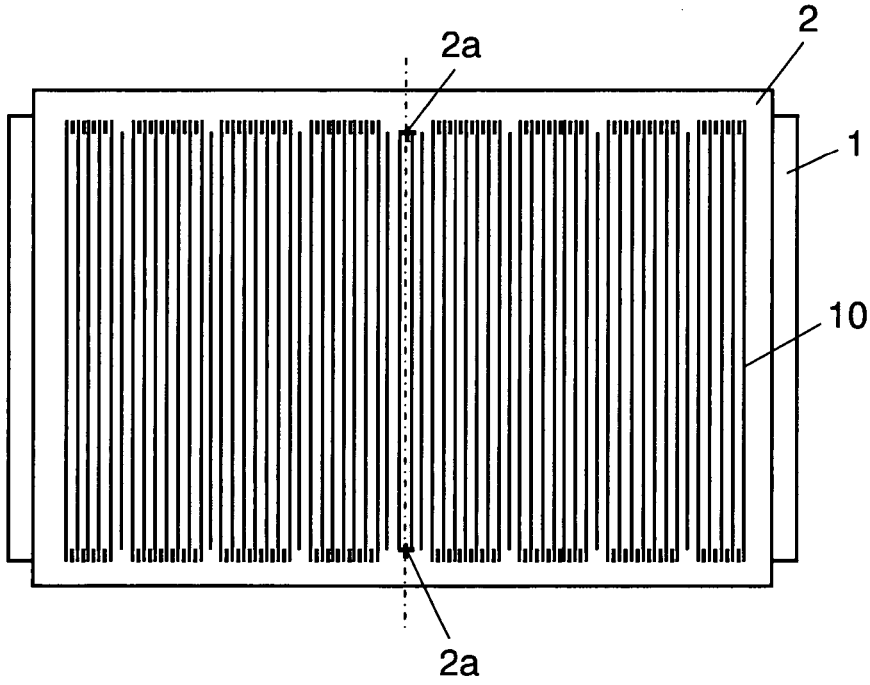
FIG. 7B is a plan view schematically showing the plasma display panel of this invention as viewed from a rear panel side, the component parts of which are formed by the division exposure method.

FIG. 7A is a plan view schematically showing a plasma display panel of this invention as viewed from a front panel side, the component parts of which are formed by the division exposure method. FIG. 7B is a plan view schematically showing the plasma display panel of this invention as viewed from a rear panel side, the component parts of which are formed by the division exposure method.

As shown in FIGS. 7A and 7B, cruciform alignment marks 1*a* and 2*a* are provided outside the display region at central parts of lower and upper ends on longitudinal sides of front panel 1 and rear panel 2. By using alignment marks 1*a* and 2*a*, alignment between front substrate 3/rear substrate 8 forming substrate 51 and photomask 53 is performed in the case of employing the division exposure method shown in FIGS. 6A to 6C. Alignment mark 1*a* of front panel 1 is formed by ITO simultaneously with the formation of transparent electrodes 4*a* and 5*a* shown in FIG. 1 on front substrate 3. Alignment mark 2*a* of rear panel 2 is formed from an electroconductive material such as AG simultaneously with the formation of data electrodes 10 shown in FIG. 1 on rear substrate 8.

By using alignment marks 1*a* and 2*a* as described above, it is possible to form the component parts forming the plasma display panel by dividing the area of the component parts into plural regions. Also, since it is possible to form the divided regions by maintaining a display quality of the divided regions to a predetermined quality, it is possible to form the large size panel.

In the case of forming the component parts of the plasma display panel by using the above-described division exposure method, depending on a form of the boundary portion which is the connection part between the plural regions formed due to the division, the boundary portion between the plural regions can be visually recognized by human eyes to deteriorate an appearance during unlighted and lighted periods as well as to disfigure the display part of the panel and adversely influence the display quality when the picture is displayed on the panel. Therefore, the rear panel has the structure shown in FIGS. 8A and 8B in this embodiment.

Figure 8A:
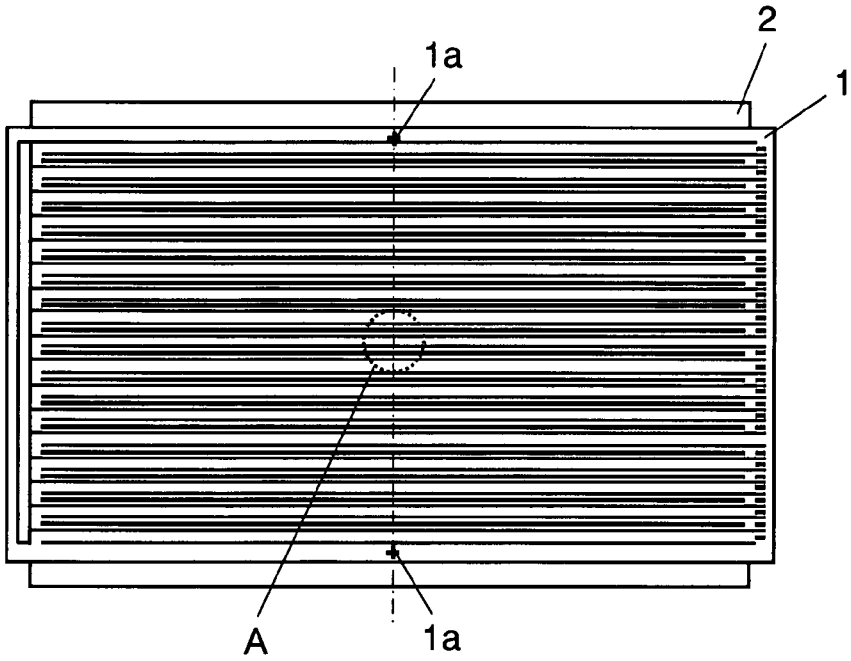
FIG. 8A is a plan view showing the rear panel to be used for the plasma display panel according to one embodiment of this invention.
Figure 8B:
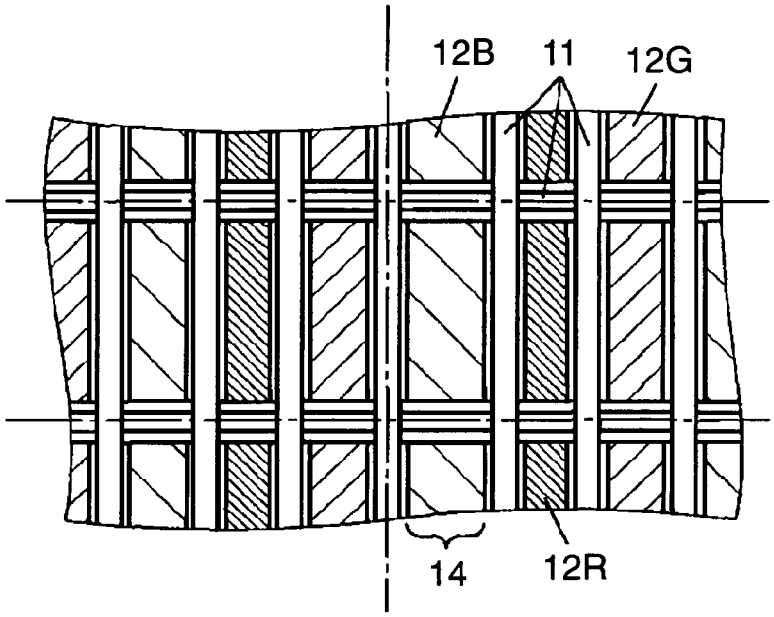
FIG. 8B is an enlarged view showing a central part of the rear panel shown in FIG. 8A.

FIG. 8A is a plan view showing the rear panel to be used for the plasma display panel according to one embodiment of this invention. FIG. 8B is an enlarged view showing a central part of rear panel 2 shown in FIG. 8A. red phosphor layer 12R green phosphor layer 12G, and blue phosphor layer 12B are formed in the form of stripes.

Rear panel 2 is provided with partitions 11 each of which is divided into plural regions in a direction parallel to data electrodes 10. Boundary portions 14 for the plural regions are used as partitions 11 on which blue phosphor layers 12B are disposed. A width of blue phosphor layer 12B serving as boundary portion 14 is wider than a width of each of red, green, and blue phosphor layers 12R, 12G, and 12B on other portions.

In the case of forming partition wall 11 at rear panel 2 of the plasma display panel by employing the division exposure method as described above, it is possible to provide a large size panel since it is possible to form the panel with the display quality of picture display being maintained to the predetermined quality by making boundary portions 14 as a connection part hardly recognized by human eyes through the formation of partitions 11 by dividing each of partitions 11 into plural regions in the direction parallel to data electrodes 10 and using plural boundary portions 14 as partitions 11 on which blue phosphor layers 12B, which are hardly more recognized by human eyes than other layers of red and green, are disposed.

As described in the foregoing, this invention is useful for providing a plasma display panel with a large size display screen and high resolution.

The invention claimed is:

1. A plasma display panel comprising:

a front panel having a front substrate having a plurality of arrays of display electrodes each including a first electrode and a second electrode opposed to each other with a discharge gap being defined between the first electrode and the second electrode; and a rear panel having a rear substrate opposed to the front substrate, partition walls for partitioning a discharge space between the rear panel and the front panel, data electrodes each formed between the partition walls such that the data electrodes intersect with the display electrodes, and phosphor layers each formed between the partition walls, wherein the rear panel forms the partition walls so as to provide the discharge space, and is divided into a plurality of regions along a direction parallel to the data electrodes, wherein the plurality of regions has at least a first exposure area and a second exposure area, wherein each of the phosphor layers is one of a blue phosphor layer which emits blue light, a red phosphor layer which emits red light, and a green phosphor layer which emits green light, wherein each of the plurality of regions has:

a plurality of discharge cells on which a blue phosphor layer is disposed;

a plurality of discharge cells on which a red phosphor layer is disposed; and a plurality of discharge cells on which a green phosphor layer is disposed, wherein at one of the partition walls a blue phosphor layer is disposed at a boundary portion, the boundary portion being formed substantially at a center of the rear panel, and the one of the partition walls divides the rear panel into the regions, and wherein the phosphor layers are formed in the form of stripes.

2. The plasma display panel according to claim 1, wherein a width of the blue phosphor layer disposed at the boundary portion is wider than that of the red phosphor layers and the green phosphor layers.

3. The plasma display panel according to claim 1, wherein the rear panel includes a photosensitive material and the rear panel is formed using a division exposure method, wherein the division exposure method includes exposing portions of the photosensitive material to light from a light source while using a photomask to block the light from unexposed portions of the photosensitive material, and wherein the unexposed portions of the photosensitive material are removed to form the partition walls.

4. The plasma display panel according to claim 3, wherein the partition walls are formed of the photosensitive material by the division exposure method using a photomask to expose the first exposure area and the second exposure area, and a connection part is disposed between and connects the first exposure area and the second exposure area.

5. The plasma display panel according to claim 4, wherein the photomask blocks the light from unexposed portions of the photosensitive material, and wherein the unexposed portions of the photosensitive material are removed to form the partition walls.

6. The plasma display panel according to claim 1, wherein the discharge cells are formed at positions where the display electrodes intersect with the data electrodes.

7. The plasma display panel according to claim 1, wherein the rear panel includes a photosensitive material and the rear panel is formed using a division exposure method, and wherein the blue phosphor layer disposed at the boundary portion is adjacent to an alignment mark used in the division exposure method.

8. The plasma display panel according to claim 1, wherein a connection part is disposed between and connects the first exposure area and the second exposure area, and wherein the boundary portion is disposed at the connection part.

9. A plasma display panel comprising:

a front panel having a front substrate having a plurality of arrays of display electrodes each including a first electrode and a second electrode opposed to each other with a discharge gap being defined between the first electrode and the second electrode; and a rear panel having a rear substrate opposed to the front substrate, partition walls for partitioning a discharge space between the rear panel and the front panel, data electrodes each formed between the partition walls such that the data electrodes intersect with the display electrodes, and phosphor layers each formed between the partition walls, wherein the partition walls of the rear panel are formed of a photosensitive material by moving a photomask between a plurality of regions of the rear panel to expose a first exposure area and a second exposure area, and a connection part is disposed between and connects the first exposure area and the second exposure area, wherein the phosphor layers include blue phosphor layers which emit blue light, red phosphor layers which emit red light, and green phosphor layers which emit green light, wherein each of the plurality of regions has:

a plurality of discharge cells on which a blue phosphor layer is disposed;

a plurality of discharge cells on which a red phosphor layer is disposed; and a plurality of discharge cells on which a green phosphor layer is disposed, wherein one of the blue phosphor layers is disposed adjacent to the connection part, and is wider than the rest of the blue phosphor layers.

10. The plasma display panel according to claim 9, wherein the photomask blocks the light from unexposed portions of the photosensitive material, and wherein the unexposed portions of the photosensitive material are removed to form the partition walls.

11. The plasma display panel according to claim 9, wherein an alignment mark is disposed on the rear panel for use when moving the photomask between the plurality of regions of the rear panel, and wherein the blue phosphor layer disposed at the boundary portion is adjacent to the alignment mark.

12. The plasma display panel according to claim 1, wherein a width of the blue phosphor layer disposed at the boundary portion is wider than that of the red phosphor layers and the green phosphor layers, and is wider than the rest of the blue phosphor layers.

* * * * *

UNITED STATES PATENT AND TRADEMARK OFFICE

CERTIFICATE OF CORRECTION

PATENT NO. : 8,174,192 B2
APPLICATION NO. : 11/795840
DATED : May 8, 2012
INVENTOR(S) : Kentaro Ueda et al.

It is certified that error appears in the above-identified patent and that said Letters Patent is hereby corrected as shown below:

On the Cover Page item (86), PCT No., replace "PCT/JP2006/026000" with
--PCT/JP2006/326000--

Signed and Sealed this
Twenty-eighth Day of August, 2012

David J. Kappos

David J. Kappos
*Director of the United States Patent and Trademark Office*